United States Patent [19]

Rodgers

[11] 4,113,209

[45] Sep. 12, 1978

[54] ROTATING KITE

[76] Inventor: Lewis Rodgers, 27470 Cochise Ave, Barstow, Calif. 92311

[21] Appl. No.: 840,979

[22] Filed: Oct. 11, 1977

Related U.S. Application Data

[63] Continuation of Ser. No. 721,340, Sep. 8, 1976, abandoned.

[51] Int. Cl.[2] ..... B64C 31/06

[52] U.S. Cl. ..... 244/153 A; D34/15 AF

[58] Field of Search ..... 244/153 R, 153 A, 154, 244/155 R, 155 A; D34/15 AF; 46/53

[56] References Cited

U.S. PATENT DOCUMENTS

| | | | |
|---|---|---|---|
| 966,143 | 8/1910 | Von Wie | 244/153 A |
| 2,793,829 | 5/1957 | Brumfield | 244/153 A |
| 3,086,738 | 4/1963 | Lubash | 244/153 A |

FOREIGN PATENT DOCUMENTS

| | | | |
|---|---|---|---|
| 820,412 | 11/1951 | Fed. Rep. of Germany | 244/153 A |

*Primary Examiner*—Trygve M. Blix
*Assistant Examiner*—Charles E. Frankfort
*Attorney, Agent, or Firm*—Robert D. Farkas

[57] ABSTRACT

A rotating kite including an elongated control arm, apparatus for affixing kite string to the free ends of the control arm, a spindle rotatably affixed to the central portion of the control arm, a plurality of rigid air engaging arms fixedly secured in a radial pattern to the spindle, a ring-like element enclosing and fixedly secured to the free ends of the air engaging arms in a wheel-like effect and a substantially flat membrane covering the ring-like element and having a plurality of slots therein adjacent the air engaging arms.

7 Claims, 3 Drawing Figures

FIG.1
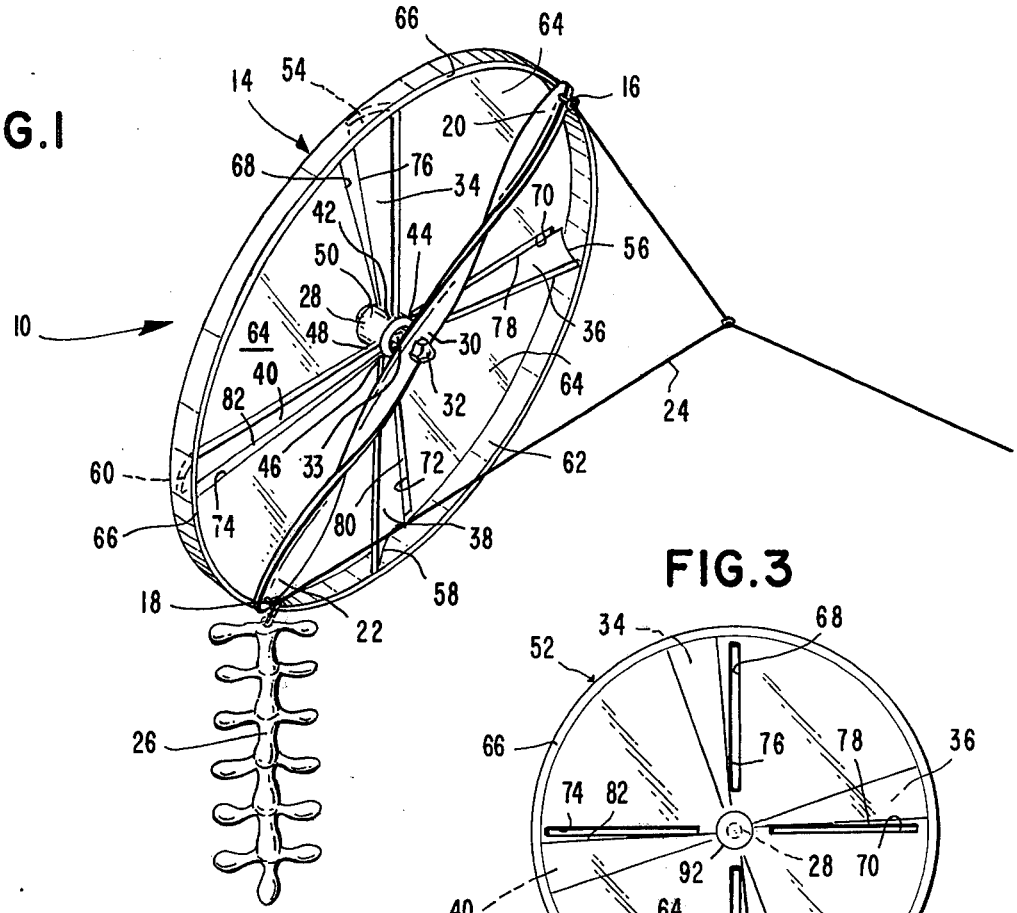
FIG.3
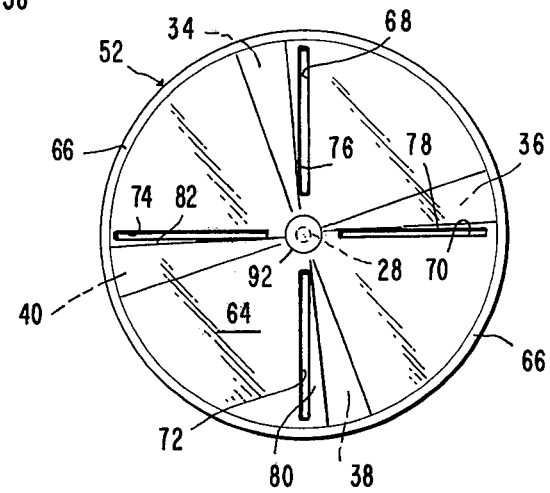
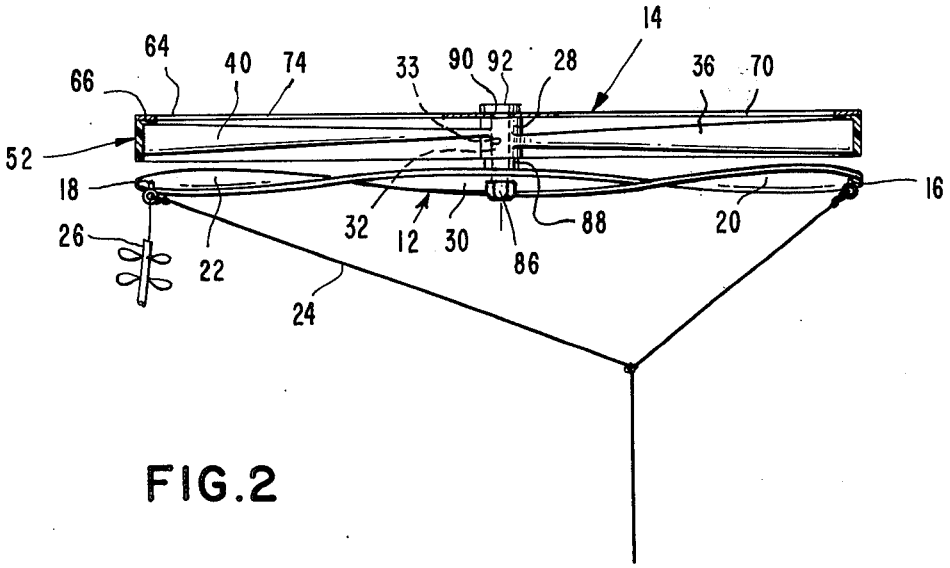
FIG.2

ROTATING KITE

This is a continuation application of Ser. No. 721,340 filed on Sept. 8, 1976 now abandoned.

BACKGROUND OF THE INVENTION

1. Field of the Invention

The present invention relates to kites, and more particularly, to a kite which provides a portion thereof that rotates as a result of air currents acting thereon.

2. Description of the Prior Art

The prior art includes several kites which rotate while they are in flight. The motion of these rotating kites is generated by air currents acting on the kite which also cause flight. Kites currently known rely entirely or substantially upon rotational motion to keep the kite airborne.

U.S. Pat. No. 966,143 issued to W. Van Wie on Aug. 2, 1910 discloses a revolving kite which provides a fragmented air engaging surface which includes a plurality of triangular vanes, and which is suspended from a pendule by a plurality of strings which bear the stress of the wind during flight.

U.S. Pat. No. 2,793,829 issued to E. B. Brumfield on May 28, 1957 teaches a rotary kite which employs a plurality of blades which function in the manner of helicopter blades and raise and keep the apparatus airborne.

The present invention provides a rotating kite which does not solely rely on rotation to remain airborne and which provides a substantially effective unitary air engaging surface.

SUMMARY OF THE INVENTION

Therefore, it is a primary object of the present invention to provide a rotating kite which does not rely solely on rotational motion for flight.

A further object is to provide a rotational kite which is designed to be structurally sturdy enough to withstand strong winds.

Another object is to provide a rotational kite which is simple in design, inexpensive to manufacture, and durable.

These objects, as well as further objects and advantages, of the present invention will become readily apparent after reading the description of a non-limiting illustrative embodiment and the accompanying drawing.

A rotating kite according to the principles of the present invention includes an elongated rigid control arm having a first free end and a second free end; means for affixing a kite string to the first and second free ends of the control arm; a spindle rotatably affixed to the central portion of the control arm, the spindle being rotatable around the longitudinal axis thereof, the longitudinal axis of the spindle being substantially normal to the longitudinal axis of the control arm; a plurality of rigid air engaging arms each fixedly secured on a first end thereof to the spindle and being radially disposed therefrom, the longitudinal axis of each of the air engaging arms being substantially perpendicular to the longitudinal axis of the spindle; a ring-like element dimensioned to enclose the second free ends of each of the air engaging arms, the second free ends each being fixedly secured thereto; and a substantially flat membrane fixedly secured to the free edges of the ring-like element farthermost from the control arm, the membrane covering the area enclosed by the ring-like element, the membrane having a plurality of slots located therein, each of the plurality of slots being adjacent one of each of the plurality of air engaging arms, one of the slots being adjacent each one of the air engaging arms, the slots permitting air currents imparting force of said air engaging arms to pass therethrough, the air currents causing the spindle to rotate.

BRIEF DESCRIPTION OF THE DRAWINGS

In order that the present invention may be more fully understood it will now be described, by way of example, with reference to the accompanying drawings in which:

FIG. 1 is a perspective view of the preferred embodiment incorporating the principles of the present invention;

FIG. 2 is a rear view of the preferred embodiment; and

FIG. 3 is a side view in cross section of the preferred embodiment.

DESCRIPTION OF THE PREFERRED EMBODIMENT

Referring now to the figures, and more particularly to FIG. 1, there is illustrated therein a rotating kite 10 including an elongated rigid control arm 12 and a rotating portion 14. The control arm 12 is preferably propeller shaped as shown and has a pair of hook eyes 16 and 18 fixedly secured, respectively, to the first and second free ends 20 and 22 thereof. The kite string 24 is fixedly secured to the hook eyes 16 and 18 in a customary kite configuration. A kite tail 26 is fixedly secured to the hook eye 18.

The rotating portion 14 includes a spindle 28 rotatably affixed to the central portion 30 of the control arm 12 by an axle 32 which passes through and journals with an aperture 33 located in the spindle 28. The longitudinal axes of the spindle 28 and the axle 32 coincide and are substantially perpendicular to the longitudinal axis of the control arm 12.

A plurality of rigid air engaging arms 34, 36, 38, and 40 are each fixedly secured, respectively, on first ends 42, 44, 46, and 48 to the outer surface 50 of the spindle 28 and are radially disposed therefrom in the same plane. Each of the air engaging arms 34, 36, 38, and 40 are equidistant from each other forming four equal quadrants. The longitudinal axes of the plurality of air engaging arms 34, 36, 38, and 40 are each perpendicular to the longitudinal axis of the spindle 28. Each of the air engaging arms 34, 36, 38, and 40 are pitched along their own longitudinal axis with all pitched in the same direction as shown.

A ring-like element 52 is dimensioned to enclose the second free ends 54, 56, 58, and 60, respectively, of the air engaging arms 34, 36, 38, and 40. The free ends 54, 56, 58, and 60 are fixedly secured to the inner surface 62 of the element 52 forming a wheel and spoke type configuration as shown.

A substantially flat membrane 64 is fixedly secured to the free edges 66 of the ring-like element 52 covering the area enclosed thereby as further illustrated in FIG. 3. A plurality of slots 68, 70, 72, and 74 are located in the membrane 64, respectively, adjacent to the edges 76, 78, 80, and 82 of the air engaging arms 34, 36, 38, and 40.

FIG. 2 illustrates the spindle 28 rotatably affixed to the central portion 30 of the control arm 12. The axle 32 is fixedly secured on one end 84 thereof to the control arm 12 by a pair of compression nuts 86 and 88. The other end 90 of the axle 32 provides a lip 92 to prevent the spindle 28 from disengaging therefrom. The compression nut 88 also serves as a bearing between the spindle 28 and the control arm 12.

FIG. 3 illustrates the flat membrane 64 fixedly secured to the free edges 66 of the ring-like element 52 and the location of the slots 68, 70, 72, and 74 relative to the edges 76, 78, 80, and 82 of the air engaging arms 34, 36, 38, and 40. The membrane 64 may be constructed of light weight plastic film, paper, or the like. The control arm 12, the air engaging arms 34, 36, 38, and 40 and the ring-like element 52 may be constructed of balsa wood, light weight plastic, or the like.

In operation, air currents engage the membrane 64 and lift the kite 10 in a conventional fashion. The air currents also engage the arms 34, 36, 38, and 40, pass through the slots 68, 70, 72, and 74 and thereby impart rotation to the rotating portion 14. The control arm 12 is preferably pitched in a direction opposite that of the air engaging arms 34, 36, 38, and 40 to cause the air currents to urge the control arm 12 in an opposing direction to stabilize the kite 10. Depending on the strength of the wind, the length and weight of the kite tail 26 can be varied accordingly.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A rotating kite comprising:

an elongated rigid control arm having a first free end and a second free end, said control arm having pitched blades to interact with the air tending to cause rotation of said control arm in a preferred direction of rotation;

means for affixing a kite string to said first and second free ends of said control arm;

a spindle rotatably affixed to the central portion of said control arm, said spindle being rotatable around the longitudinal axis thereof, said longitudinal axis of said spindle being substantially normal to the longitudinal axis of said control arm;

a plurality of rigid air engaging arms each fixedly secured on a first end thereof to said spindle and being radially disposed therefrom, the longitudinal axis of each of said air engaging arms being substantially perpendicular to said longitudinal axis of said spindle;

a ring-like element dimensioned to enclose the second free ends of each of said air engaging arms, said second free ends each being fixedly secured thereto, and a membrane fixedly secured to the free edges of said ring-like element farthermost from said control arm, said membrane covering the area enclosed by said ring-like element, said membrane having a plurality of slots located therein, each of said plurality of slots being adjacent one of each of said plurality of air engaging arms, said slots permitting air currents imparting force on said air engaging arms to pass therethrough, said air currents causing said spindle to rotate.

2. A rotating kite as claimed in claim 1, wherein said affixing means comprises a pair of hook eyes fixedly secured to said first and second free ends of said longitudinal rigid control arm, one of said hooks fixedly secured to said first free end, the other of said hooks fixedly secured to said second free end.

3. A rotating kite as claimed in claim 1, wherein said spindle is rotatably affixed to said control arm by an axle passing through and dimensioned to journal with a longitudinal aperture located in said spindle, said axle fixedly secured on one end thereof to said control arm, the other end of said axle providing a lip to prevent said spindle from disengaging therefrom.

4. A rotating kite as claimed in claim 1, wherein each of said plurality of air engaging arms are pitched about said longitudinal axes thereof to increase engagement with said air currents.

5. A rotating kite as claimed in claim 4, wherein all of said plurality of air engaging arms are pitched in the same direction.

6. A rotating kite as claimed in claim 1, further comprising a kite tail fixedly secured to one of said free ends of said control arm.

7. A rotating kite as claimed in claim 1, wherein each of said plurality of air engaging arms is equidistant from an adjacent one of said air engaging arms.

* * * * *